United States Patent [19]

Libouton et al.

[11] Patent Number: 4,566,920

[45] Date of Patent: Jan. 28, 1986

[54] COMPOSITIONS OF THE EXPLOSIVE EMULSION TYPE, PROCESS FOR THEIR MANUFACTURE AND APPLICATION OF THESE COMPOSITIONS

[76] Inventors: Jean-Claude Libouton, Nieuwe 27 rue Tremouroux, Orbais-Perwez, Belgium, B-5923; Lucien Waterlot, Hoevenstraat 10, Mol, Belgium, B-2400; Georges Van Roy, rue Victor Hugo 223, Bruxelles, Belgium, B-1040

[21] Appl. No.: 585,554

[22] Filed: Mar. 2, 1984

[30] Foreign Application Priority Data

Mar. 18, 1983 [EP] European Pat. Off. ..... 83 870026

[51] Int. Cl.[4] ..... C06B 45/02

[52] U.S. Cl. ..... 149/21; 149/2; 149/61; 149/76; 149/77; 149/110; 149/112; 149/109.6

[58] Field of Search ..... 149/2, 21, 109.6, 110, 149/61, 112, 76, 77

[56] References Cited

U.S. PATENT DOCUMENTS

| | | | |
|---|---|---|---|
| 4,294,633 | 10/1981 | Clay | 149/2 |
| 4,357,184 | 2/1982 | Binet et al. | 149/21 X |
| 4,371,408 | 2/1983 | Fillman | 149/62 X |
| 4,394,198 | 7/1983 | Takevchi et al. | 149/21 |
| 4,398,976 | 8/1983 | Hattori et al. | 149/21 |
| 4,414,044 | 11/1983 | Takeuchi et al. | 149/2 |
| 4,482,403 | 11/1984 | Takeuchi et al. | 149/2 |

*Primary Examiner*—Stephen J. Lechert, Jr.

[57] ABSTRACT

An explosive composition of the water-in-oil emulsion type includes at least one emulsified gel formed of an oxidizing solution of an inorganic salt dissolved in water and a fuel phase containing a liquid hydrocarbon and an emulsifier in combination with an inert or reactive lighting constituent and, if appropriate, one or more oxidizing salts or metal fuels. Pursuant to the invention the composition additionally contains from 4% to 55% of inert or semi-inert solids. The explosive composition provides enhanced safety characteristics through detonation velocity reduction and is thus well suited for dangerous atmospheres such as those encountered in coal mines. Additionally, the explosive composition exhibits a nonsticky plastic to semiplastic texture which facilitates cartridging on conventional machinery, all while retaining normal detonation characteristics.

25 Claims, No Drawings

COMPOSITIONS OF THE EXPLOSIVE EMULSION TYPE, PROCESS FOR THEIR MANUFACTURE AND APPLICATION OF THESE COMPOSITIONS

The present invention relates to explosive compositions of the water-in-oil emulsion type, the process for their manufacture and their application.

The drawbacks inherent in simple ammonium nitrate/ oil mixtures, called ANFO, namely their low power, their reluctance to detonate and their poor behaviour in the presence of water, have for a long time prompted research work to improve this type of composition.

A major improvement has been made particularly by manufacturing them in the form of explosive slurries, of which there are now numerous formulations on the market; in these slurries, in the presence of various nitrates in concentrated solution, the initial oil has been progressively replaced by other types of fuel.

Another method, of more recent origin, consisted in preparing a much more intimate mixture of the solution of combustion-supporting nitrates with the fuel oil by combining them in the form of an emulsion.

In this emulsion, an aqueous solution of the supporter of combustion is emulsified in the form of a phase dispersed in a continuous carbon-based fuel phase; a lightening constituent, introduced in the form of mechanically included air, or in the form of a gas obtained by a chemical means, or alternatively in the form of microbeads, which are either spherical and of the "microball" type or of any other shape, such as perlites, polyurethane, polyvinylidene chloride or expanded polystyrene, is necessary to adjust the density and to ensure sensitisation in diameters which can be very small (of the order of 30 mm or less).

U.S. Pat. Nos. 3,447,978, 4,008,108, 4,110,134, 4,138,281 and 4,141,767, European Pat. No. 0,019,458, German Pat. No. 2350605 and Belgian Pat. Nos. 881,116 and 880,736 describe this kind of composition; numerous patents specify the nature of the supporter(s) of combustion used, the nature of the oily fuel phase and also the nature of the emulsifiers and the gaseous constituents employed.

Thus, it is known that, in general, an explosive emulsion consists of about 93 to 97% of an emulsified gel (including 5 to 15 parts of water, 70 to 80 parts of one or more combustion-supporting inorganic salts, 3 to 6 parts of fuel oil and, if appropriate, of wax, and 1 to 2 parts of emulsifier), to which about 3 to 7% of lightening material is added.

Although, in this way, the sensitivity and the water resistance are in fact improved by comparison with ANFO, it is nonetheless true that the power is not changed and that the soft, pitch-like and sticky consistency of the product obtained makes it difficult to package.

Hitherto, the known modifications and improvements which have been made to the above products have been concerned with boosting the power effect.

It was this aim which led to introducing, into the composition, up to 12% of auxiliary fuels (that is to say fuels other than the oil and wax already mentioned) consisting mainly of metals—aluminium being the most widely used—in which case the formulation now contains only 88% of the lightened emulsified gel in addition to the 12% of metal; packaging, especially where the composition is to be introduced into a cartridge of small diameter, is still difficult, as stated earlier.

As the study of aluminised ANFO has furthermore shown that, beyond this proportion, the gain in energy is no longer economically justifiable, and as this gain was the only aspect to have been investigated hitherto, it did not seem interesting to continue the study of mixtures of gel with other materials, unless this further study were concerned with ANFO per se, rather than with the object of improving it.

The Applicant Company has discovered that, in the emulsified gel which may or may not contain the auxiliary metal fuels referred to above, the introduction of noncombustible, inert solids or semi-inert solids, that is to say solids which only react behind the detonation wave, does not stop the process of detonation of a cartridge, or of several adjoining cartridges, when priming is carried out by means of a standard detonator, the only proviso being that the aeration of the final mixture is similar to that of the compositions of the water-in-oil emulsion type not containing inert or semi-inert material.

The present invention therefore relates firstly to an explosive composition of the water-in-oil emulsion type, comprising at least one emulsified gel consisting of an oxidising solution obtained from at least one inorganic salt dissolved in water and of a fuel phase containing at least one liquid hydrocarbon and an emulsifier, in combination with an inert or reactive lightening constituent and, if appropriate, with one or more oxidising salts or metal fuels, characterised in that it contains from 4 to 55% of inert or semi-inert solids.

The terms "inert" and "semi-inert" must be understood as having the meanings accepted in explosives technology. The mixtures of emulsified gel with inert or semi-inert materials, in proportions ranging from 96/4 to 45/55, always constitute true explosives, the detonation of which is complete and normal, provided that they contain the usual lightening constituent for emulsions of the water-in-oil type, which adjusts their density and their sensitisation. It has been found that this noteworthy property can serve as a basis for producing new explosives, the novelty of which consists in ensuring that they are always derived from an emulsified gel, but that the addition of the said materials to the gel ultimately provides: either certain safety properties in the dangerous atmospheres of coal mines, or a new, non-sticky, plastic to semi-plastic texture which makes the explosives easy to introduce into a paper cartridge on a conventional cartridging machine (of the cutting type, screw type or tampingbar type), or even a combination of these two properties.

In particular, the safety property is achieved by the fact that the introduction of the inert or semi-inert materials into the emulsified and aerated gel is characterised by a reduction in its detonation velocity (it being possible for this to be adjusted to values of less than 2,000 m/s) and in its energy potential, which are the very factors fundamental in adjusting the safety of an explosive.

This safety results, in particular, in producing compositions of the types referred to in Anglo-Saxon countries as P1, P3 and especially P5, and is determined in this case by means of test firings from a circular mortar in a dusty atmosphere containing firedamp, in accordance with standards well known in the profession.

In one embodiment of the invention, the compositions contain added inert materials from the family of the alkali metal chlorides or bicarbonates, to the extent of 10 to 45%, which makes it possible to obtain safety levels such as those defined above, the salts to be considered being, inter alia, NaCl or $NaHCO_3$.

In the case where it is desired to ensure P5 type safety, this inert material can be, in particular, NaCl having a particle size of 250 to 500 microns and preferably in a proportion of 10 to 45%.

The same safety effect is achieved by using semiinert materials, which have the advantage of reducing the power less than the inert materials, because they behave more like the latter in test firings in free air, whereas they behave as active materials, with a delayed energy-producing effect, in test firings under confined conditions; amongst these semi-inert materials, the pairs of salts $NaNO_3/NH_4Cl$ or $KNO_3/NH_4Cl$, in proportions close to stoichiometry, are preferred.

It has been found that, to ensure easy introduction into a paper cartridge, on a conventional machine, of the explosive containing the salts, as stated above, it is necessary to combine additional inert materials with these salts, these materials being silicates or diatomaceous earths or a mixture of the two in proportions of 1 to 4 parts of the first and 0 to 7 parts of the second, in the formulation, depending on the degree of plasticity which it is desired to obtain and which is compatible with the capabilities of the machine; in this respect, it should be pointed out that the Rollex machine, which is the best-known cartridging machine of the cutting type, makes it possible to extrude a fairly wide range of textures from plastic to semi-pulverulent, provided that they are coherent and not sticky. Thus, it is perfectly possible to combine the inert or semi-inert materials to be introduced into the gel, in such a way that the same explosive emulsion simultaneously possesses both the properties imparted to the formulation by the use of these materials, namely safety when used in coal mines, and extrudability.

In such compositions, the inert material can be a premix of NaCl having a particle size of 250 to 500 microns, calcium silicate and diatomaceous earth, in a preferred proportion of 17 to 45%, the said premix comprising 15 to 38 parts of NaCl, 1 to 4 parts of calcium silicate and 0 to 7 parts of diatomaceous earth, which simultaneously ensures P5 type safety and introduction into a paper cartridge on a conventional machine.

According to the variant, a semi-inert material is used which is a premix of $NaNO_3$ or $KNO_3$, in which 80 to 90% of the particles are between 53 and 125 microns, $NH_4Cl$, in which 50% of the particles are larger than 200 microns, calcium silicate and diatomaceous earth, in a proportion advantageously of between 25 and 43%, the premix comprising 11 to 24 parts of $NaNO_3$ or $KNO_3$,.7 to 15 parts of $NH_4Cl$, 1 to 2 parts of silicate and 4 to 5 parts of diatomaceous earth, simultaneously ensuring P5 type safety and cartridging on a conventional machine.

Advantageously, part of the inert materials consists of calcium silicate, preferentially of the silene or Calflo types, and the diatomaceous earth is of the hyflosupersel type.

In a second step, and in order to comply with the current regulations, especially in France, Belgium and West Germany, relating to high-safety explosives, it has proved necessary to develop compositions whose detonation velocity is substantially less than 2,000 m/s. To achieve this result, the Applicant Company introduced an organic lightening agent into the emulsified gels, in addition to the inert salts already mentioned, leading to a significant increase in the porosity of the explosive (its density on cartridging is of the order of 0.8 g/cc).

The lightening agent must have an apparent density of less than 30 g/liter and the one which has hitherto given the best results is expanded polystyrene having an apparent density of 18 g/liter. To balance the chemical reaction of the explosive, an additional supply of oxygen must be provided for the composition by adding one or more inorganic oxidising agents. This oxidising agent can be an inorganic nitrate, preferably of high molecular weight, in combination, if appropriate, with an inorganic perchlorate. These materials are added to the base gel and probably act on the detonation wave. As regards the inert materials, the proportion of which remains between the limits already defined (from 4 to 55%), they consist essentially of extinguishing salts (for example NaCl) and sand. The ease of detonation of the composition and its ability to be introduced into a cartridge are improved by the presence of sand of appropriate particle size. In certain cases, the proportion of base gel can be limited to 25–30% of the final composition.

Additionally, it has been found that the emulsion containing the lightening agent can be made extrudable on the cutting machine without thereby possessing any safety property in the presence of an explosive gas atmosphere. In this case, it is still true that 4 to 55% of inert or semi-inert materials can be introduced into the emulsified gel, as stated above, while retaining explosive properties; as safety is not taken into account amongst the explosive properties, neither the salts such as NaCl or $NaHCO_3$, nor the pairs $NaNO_3/NH_4Cl$ or $KNO_3/NH_4Cl$, are used, and only the additional materials are used, such as silicates or diatomaceous earths or a mixture of the two in a preferred proportion of 1 to 4 parts of the first and 0 to 7 parts of the second, so as to constitute 10 to 20% of the formulation, any remainder being a solid filler which is inert, like simple sand, or which participates in the reaction, like metal powders or combustible products.

Thus, the case where 10% of inert materials are used will correspond to a premix comprising 2.5 to 3% of calcium silicate and 7.5 to 7% of diatomaceous earths; the case where it is desired to employ, for example, 45% of inert materials will correspond to a premix consisting of 2.5 to 6% of silicate, 7.5 to 14% of diatomaceous earths and 25 to 35% of sand.

Finally, it has been pointed out that, in order to ensure extrudability, the diatomaceous earths can be replaced by non-inert hydrophobic materials such as calcium stearate; for this purpose, 1 to 3 parts of the latter should preferably be combined with 3 to 7 parts of silicate; in contrast to the other additives considered hitherto, it is necessary to take into account, in calculating the thermodynamic balance of the explosive, the fact that the stearates have an energy potential which participates in the primary detonation reaction.

The manufacturing process makes it possible to use a continuous or batch technique. The inert or semi-inert materials used for extrudability and for safety in an explosive atmosphere are fed, in the form of a premix, by means of a metering apparatus, into a continuous or batch mixer, where they meet either the hot gel leaving the emulsifying apparatus, and the lightening constituent (continuous process), or a cold gel which has already been stored for a certain time and to which the lightening constituent is also added.

The final product is poured or pumped onto the conveyor belt of the cartridging machine; in the case where a hot gel is used, this belt must be cooled so that the temperature does not exceed about 40° C. when cutting takes place.

The invention covers the application of the explosive compositions of the invention which have either a safety property in respect of the atmospheres encountered in coal mines, or the ability to be introduced into paper cartridges on a machine of the conventional type, or both these properties simultaneously, while the explosive retains normal detonation characteristics, even in a small diameter.

The invention will be described in greater detail, by way of illustration and without implying a limitation, with the aid of the examples which follow.

In Examples 1 to 9, the gel prepared at 75° C. consists of:

| the following solution of nitrates: | |
|---|---|
| water | 5 parts by weight |
| $NaNO_3$ | 5 parts by weight |
| $Ca(NO_3)_2$, technical grade | 40 parts by weight |
| $NH_4NO_3$ | 42.75 parts by weight |
| the oily phase | 5.5 parts by weight |
| the emulsifier | 1.75 parts by weight |
| | 100.— |

In Examples 10 to 12, the gel consists of:

| the following solution of nitrates: | |
|---|---|
| water | 6.5 parts by weight |
| $NaNO_3$ | 5 parts by weight |
| $Ca(NO_3)_2$, technical grade | 30 parts by weight |
| $NH_4NO_3$ | 51.1 parts by weight |
| the oily phase | 5.6 parts by weight |
| the emulsifier | 1.8 parts by weight |
| | 100.— |

EXAMPLE 1

A finely divided, emulsified gel, comprising, in proportions according to the rules of the art:

| | |
|---|---|
| a solution of nitrates | (≅92.7%) |
| a fuel phase | (≅5.5%) |
| an emulsifier | (≅1.8%), |

is prepared hot by one or other of the processes described in the literature. 50% of the emulsified gel (hot or cooled) is mixed with 45% of NaCl and 5% of C15-250 type microbeads; the NaCl is of a type having a particle size of between 250 and 500 microns.

The resulting explosive emulsion, at a density of 1.15, detonates with a velocity of 2,825 m/s in a diameter of 30 mm using a No. 8 detonator; after storage for 6 months, this velocity is still 2,630 m/s. The safety of the emulsion is of the P5 type; the emulsion is not intended for extrusion on a Rollex machine, but it can be introduced into a plastic cartridge on a Chub-Pack machine.

EXAMPLE 2

50% of the emulsified gel of Example 1 is mixed with 45% of a premix consisting of 38 parts of NaCl and 7 parts of guhr, and with 5% of C15-250 microbeads.

In this case, the explosive emulsion is such that it simultaneously has the safety characteristics of a P5 type explosive and the property of being able to be introduced into a paper cartridge on the cutting machine; in a diameter of 30 mm, the density is 1.15 and the velocity is 2,870 m/s for the fresh explosive, using a No. 8 detonator; after 3 months, the velocity is 2,700 m/s.

The critical diameter for a composition of this type is between 10 and 15 mm; in a diameter of 15 mm, the velocity is 2,300 m/s. In a ballistic mortar, the relative power is 20.8% of that of blasting gelatine.

EXAMPLE 3

The characteristics of the explosive emulsion of Example 2 do not change, but the extrudability is even better if the 7% of guhr is replaced by a mixture comprising 2% of calcium silicate of the Silene or Calflo type and 5% of diatomaceous earth of the Hyflosupersel type.

EXAMPLE 4

The explosive emulsions based on the gel of Example 1 retain the P5 type safety properties if, for 5 to 8% of microbeads, the amount of gel increases from 50 to 70% while the NaCl drops from 45 to 20%; this is the case, for example, of the composition comprising 70% of emulsified gel, 25% of NaCl and 5% of microbeads; this formulation does not have the characteristics of being extrudable on a cutting machine; compared with the composition of Example 1, the detonation velocity in a diameter of 30 mm is increased by about 400 m/s and is more than 3,000 m/s.

On the other hand, the composition comprising 69% of emulsified gel, 26% of a premix consisting of 19 parts of NaCl, 2 parts of Silene or Calflo and 5 parts of Hyflosupersel, and 5% of C15-250 microbeads has a P5 type safety, a density of 1.1, a velocity of 2,400 m/s in a diameter of 30 mm and a power of 145 cc on a Trauzl block, and can be cartridged on a cutting machine.

EXAMPLE 5

According to the invention, it is also possible to envisage an explosive emulsion having solely the ability to be cartridged on the conventional machine, without at the same time having a safety property in respect of the dangerous atmospheres of coal mines; this is the case of the composition comprising 50% of emulsified gel, 5% of microbeads, 4% of calcium silicate, 9% of diatomaceous earth and 32% of Rhine sand. Using a No. 8 detonator, cartridges having a diameter of 30 mm detonate perfectly with a transmission distance of the order of 2 cm in free air and a velocity of the order of 2,600 m/s.

EXAMPLE 6

The gel is prepared as in Example 1.

An explosive emulsion which contains 50% of this gel in combination with 43% of a premix comprising 24 parts of $NaNO_3$, 14 parts of $NH_4Cl$, 1 part of silicate and 4 parts of diatomaceous earth, and 7% of C15-250 microbeads has a P5 type safety and can be introduced into a paper cartridge on a conventional machine; its detonation velocity is 2,100 m/s.

EXAMPLE 7

A composition of the same type as in Example 6, containing 70% of the emulsified gel, 25% of a premix consisting of 11 parts of $NaNO_3$, 7 parts of $NH_4Cl$, 2 parts of silicate and 5 parts of diatomaceous earth, and 5% of C15-250 microballs, has the properties of an explosive with a P5 type safety and can be introduced into a paper cartridge; its detonation velocity is 2,750 m/s in a diameter of 30 mm, in free air; its power on a Trauzl block is 175 cc and its density is 1.0.

The preferred particle size distributions for the salts used in Examples 6 and 7 are: 80 to 90% between 53 and 125 microns for the $NaNO_3$ and 50% larger than 200 microns for the $NH_4Cl$.

EXAMPLE 8

A solution of the same type as in Example 6, lightened by the addition of microbeads, can have a boosted power, such as, for example, the formulation which contains 86% of emulsified gel, 5% of aluminium powder, 5% of microbeads and 4% of calcium silicate; in a diameter of 30 mm and using a No. 8 detonator, the transmission distance (aptitude) is still of the order of 2 cm in free air, but the velocity reaches 3,500 m/s, whereas the power, which is only 270 cc on a lead block, in the same case, without aluminium (90% of gel), increases here to 340 cc.

EXAMPLE 9

The examples which follow are intended to show the advantages which can result from using expanded polystyrene as the lightening material.

A composition comprising from 40 to 50% of emulsified gel (base gel) as described in Example 1, from 2 to 2.5% of expanded polystyrene having a density of 18 g/liter, from 14 tp 15% of NaCl, from 11 to 16% of $NaNO_3$ and 27.5% of sand having an average particle size of 0.4 mm has, after extrusion on a Rollex machine, a density of 0.8 g/cc, a detonation velocity varying from 1,600 to 1,800 m/s in a diameter of 30 mm and an aptitude of 1 cm in free air, which can reach 5 cm when the test is carried out under confined conditions.

The power on a Trauzl block is equivalent to that of the improved French layer explosives (170 cc), and the composition mentioned also has their safety properties in respect of firedamp (non-ignition of the firedamp by suspended charges of up to 1,500 g).

EXAMPLE 10

The aptitude in free air, and also the keeping properties of similar formulations, were improved in the following compositions: 40% of base gel in combination with 14% of NaCl, 10% of ammonium perchlorate or potassium perchlorate, 8% of sodium nitrate or barium nitrate, 26% of sand having a particle size of between 0.25 and 1 mm, and 2% of expanded polystyrene having a density of 18 g/ liter. In this case, the aptitude reaches 2 cm in free air. It reaches 3 cm with a composition containing 60% of base gel, 15% of $KCLO_4$, 10% of $Ba(NO_3)_2$, 13% of sand and 2% of expanded polystyrene having a density of 18 g/liter. However, these formulations do not have the safety defined in Example 9, in respect of firedamp.

EXAMPLE 11

The safety in respect of firedamp is further improved with a composition containing from 25 to 30% of base gel in combination with from 5 to 10% of potassium perchlorate or ammonium perchlorate, from 8 to 10% of sodium nitrate or barium nitrate, from 20 to 25% of sodium chloride as an extinguishing agent, from 27 to 30% of sand having a particle size of between 1 mm and 0.25 mm, and 2% of expanded polystyrene having a density of 18 g/liter.

This composition has a detonation velocity of between 1,300 and 1,600 m/s, a density of 0.8 g/cc and an aptitude in free air which can be as much as 2 cm.

Provided the detonation velocity is less than 1,500 m/s, it complies with the safety test carried out in a firedamp gallery in accordance with the Belgian method with type 3 agrement (1,500 g in a grooved cylinder -shock plate at 60 cm).

EXAMPLE 12

A composition containing from 90 to 93% of base gel in combination with 6.5% of aluminium of the "atomised" type and from 1 to 1.5% of expanded polystyrene having a density of 18 g/liter has a density of 0.9 g/cc and a detonation velocity of 2,500 m/s in free air.

We claim:

1. An explosive composition of the water-in-oil emulsion type, comprising at least one emulsified gel comprising an oxidising solution obtained from at least one inorganic salt dissolved in water and of a fuel phase containing at least one liquid hydrocarbon and an emulsifier, in combination with an inert or reactive lightening constituent characterised in that it contains texturizing means for facilitating cartridging, the texturizing means including from 4 to 55% of inert or semi-inert solids comprising a silicate associated with diatomaceous earths in proportion of 1 to 4 parts of silicate and 0 to 7 parts of diatomaceous earths, the inert or semi-inert solids being in a form other than microspheres and being free of entrapped gas, the composition having a non-sticky plastic to semi-plastic texture suitable for introduction to a paper cartridge on a conventional cartridging machine.

2. A composition according to claim 1, characterised in that it contains added inert materials from the family of the alkali metal chlorides or bicarbonates, to the extent of 10 to 45%, whereby enhanced safety is achieved for use in dangerous atmospheric environments.

3. A composition according to claim 2, characterised in that the said salts are NaCl or $NaHCO_3$.

4. A composition according to claim 2, characterised in that the said salt is NaCl having a particle size of 250 to 500 microns.

5. A composition according to claim 1, characterised in that the pairs of salts $NaNO_3$/ $NH_4Cl$ or $KNO_3/HN_4Cl$, in proportions close to stoichiometry, are used to the extent of 10 to 45%, whereby enhanced safety is achieved for use in dangerous atmospheric environments.

6. A composition according to claim 1, characterised in that the silicate is calcium silicate, preferentially of the Silene or Calflo types, and the diatomaceous earth is of the Hyflosupersel type.

7. A composition according to claim 1 characterised in that the materials constitute 4 to 15% of the composition.

8. A composition according to claim 1, characterised in that the inert material comprises a premix of NaCl having a particle size of 250 to 500 microns, calcium silicate and diatomaceous earth, in a preferred proportion of 17 to 45%, the said premix comprising 15 to 38 parts of NaCl, 1 to 4 parts of calcium silicate and 0 to 7 parts of diatomaceous earth.

9. A composition according to claim 1, characterised in that a semi-inert material is used which is a premix of $NaNO_3$ or $KNO_3$, in which 80 to 90% of the particles are between 53 and 125 microns, $NH_4Cl$, in which 50% of the particles are larger than 200 microns, calcium silicate and diatomaceous earth, in a proportion advantageously of between 25 and 43%, the premix comprising 11 to 24 parts of $NaNO_3$ or $KNO_3$, 7 to 15 parts of $NH_4Cl$, 1 to 2 parts of silicate and 4 to 5 parts of diatomaceous earth.

10. A composition according to claim 1, characterised in that it comprises from 20 to 60% of emulsified gel, from 1.5 to 3% of expanded polystyrene, from 5 to 25% of NaCl, from 5 to 20% of sodium nitrate or barium nitrate, from 0 to 20% of potassium perchlorate or ammonium perchlorate and from 10 to 30% of sand.

11. A composition according to claim 10, characterised in that the proportion of the various constituents is limited to between 40 and 45% for the base gel, to between 2 and 2.5% for the expanded polystyrene, to between 14 and 15% for the NaCl, to between 11 and 16% for the $NaNO_3$, in the absence of perchlorate, and to 27–30% of sand.

12. A composition according to claim 10, characterised in that the proportion of the various constituents is limited to 25 to 30% of base gel,
20 to 25% of NaCl,
5 to 10% of $KClO_4$ or $(NH_4)ClO_4$,
8 to 10% of $NaNO_3$ or $Ba(NO_3)_2$ and
25 to 30% of sand, whereby a final explosive may be cartridged having a safety in respect of firedamp, as defined by the Belgian regulations for type III explosives.

13. A composition according to claim 10 characterised in that the particle size of the sand is between 0.25 and 1.0 mm.

14. A composition according to claim 10 characterised in that the polystyrene is preferably expanded to a density of 18 g/liter in order to give the final explosive a density of the order of 0.8 g/cc.

15. A composition according to claim 11 characterized in that the particle size of the sand is between 0.25 and 1.00 mm.

16. A composition according to claim 12 characterized in that the particle size of the sand is between 0.25 and 1.00 mm.

17. A composition according to claim 11 characterized in that the polystyrene is preferably expanded to a density of 18 g/liter in order to give the final explosive a density of the order of 0.8 g/cc.

18. A composition according to claim 12 characterized in that the polystyrene is preferably expanded to a density of 18 g/liter in order to give the final explosive a density of the order of 0.8 g/cc.

19. A method of generating controlled explosive forces having normal detonation characteristics in dangerous atmospheric environments such as those encountered in coal mines, said method comprising the steps of providing a cartridged explosive formed of an explosive composition constructed in accordance with claim 1 and detonating the cartridged explosive.

20. A method of forming a cartridged explosive, said method comprising the steps of (a) providing an explosive composition constructed in accordance with claim 1 and
(b) cartridging the explosive composition using conventional cartridging machinery.

21. A process for the manufacture of compositions according to claim 1, characterised in that the inert or semi-inert materials are fed, in the form of a premix, by means of a metering apparatus, into a continuous or batch mixer, where they meet either a hot gel leaving the emulsifying apparatus, the lightening constituent and, if appropriate, the fuels, or a cold gel which has already been stored for a certain time and to which the lightening constituent and, if appropriate, the metal fuels are also added.

22. A process according to claim 21, characterised in that the final product is poured or pumped onto the conveyor belt of the cartridging machine, this belt being cooled, in the case where a hot gel is used, so that the temperature does not exceed 40° C. when cartridging takes place.

23. A composition according to claim 1 wherein the emulsified gel includes one or more oxidizing salts.

24. A composition according to claim 1 wherein the emulsified gel includes one or more metal fuels.

25. An explosive composition of the water-in-oil emulsion type comprising at least one emulsified gel including an oxidizing solution obtained from at least one inorganic salt dissolved in water and of a fuel phase containing at least one liquid hydrocarbon and an emulsifier, in combination with an inert or reactive lightening constituent characterized in that the composition contains texturizing means for facilitating cartridging, the texturizing means including from 4–55% of inert or semi-inert solids comprising a silicate associated with silices in proportions of 1 to 4 parts of silicate and 0 to 7 parts of silices, the inert or semi-inert solids being in a form other than microspheres and being free of entrapped gas, the composition having a non-sticky plastic to semi-plastic texture suitable for introduction into a paper cartridge on a conventional cartridging machine of the cutting type.

* * * * *